US009230535B2

(12) United States Patent
Yano

(10) Patent No.: US 9,230,535 B2
(45) Date of Patent: Jan. 5, 2016

(54) ACTIVE VIBRATION NOISE CONTROL APPARATUS

(75) Inventor: Atsuyoshi Yano, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 120 days.

(21) Appl. No.: 14/128,636

(22) PCT Filed: Jan. 20, 2012

(86) PCT No.: PCT/JP2012/000339

§ 371 (c)(1),
(2), (4) Date: Dec. 23, 2013

(87) PCT Pub. No.: WO2013/108294

PCT Pub. Date: Jul. 25, 2013

(65) Prior Publication Data

US 2014/0126739 A1 May 8, 2014

(51) Int. Cl.
*G10K 11/178* (2006.01)

(52) U.S. Cl.
CPC ..... *G10K 11/178* (2013.01); *G10K 2210/1282* (2013.01); *G10K 2210/3028* (2013.01)

(58) Field of Classification Search
None
See application file for complete search history.

(56) References Cited

U.S. PATENT DOCUMENTS

| | | | | |
|---|---|---|---|---|
| 5,544,080 | A * | 8/1996 | Kobayashi et al. | 700/280 |
| 5,638,305 | A * | 6/1997 | Kobayashi et al. | 700/280 |
| 2004/0247137 | A1 | 12/2004 | Inoue et al. | |
| 2007/0233478 | A1 * | 10/2007 | Sakamoto et al. | 704/233 |
| 2008/0240456 | A1 * | 10/2008 | Sakamoto et al. | 381/71.4 |
| 2011/0142248 | A1 | 6/2011 | Sakamoto et al. | |

FOREIGN PATENT DOCUMENTS

| | | |
|---|---|---|
| CN | 102097094 A | 6/2011 |
| JP | 5 61485 | 3/1993 |
| JP | 7 230289 | 8/1995 |
| JP | 8 261277 | 10/1996 |
| JP | 2000 99037 | 4/2000 |
| JP | 2004-361721 | 12/2004 |
| JP | 2008 40410 | 2/2008 |
| JP | 2011 121534 | 6/2011 |

OTHER PUBLICATIONS

Combined Chinese Office Action and Search Report issued Mar. 19, 2015 in Patent Application No. 201280035029.2 (with partial English language translation and English translation of categories of cited documents).
International Search Report Issued Mar. 19, 2012 in PCT/JP12/000339 Filed Jan. 20, 2012.
Office Action issued Aug. 26, 2014 in Japanese Patent Application No. 2013-554073 (with English translation).

* cited by examiner

*Primary Examiner* — Paul Huber
(74) *Attorney, Agent, or Firm* — Oblon, McClelland, Maier & Neustadt, L.L.P.

(57) ABSTRACT

An active vibration noise control apparatus with which vibration noise can be reduced stably and effectively by preventing divergence of a filter coefficient or a delay in convergence due to an effect of a transfer characteristic on a secondary path. The active vibration noise control apparatus calculates an update step size in accordance with a magnitude of a gain in the transfer characteristic corresponding to a frequency of vibration noise, where the transfer characteristic is on the secondary path for propagation of a secondary vibration noise for reducing the vibration noise, and updates the filter coefficient on the basis of the calculated update step size.

8 Claims, 8 Drawing Sheets

ACTIVE VIBRATION NOISE CONTROL APPARATUS

TECHNICAL FIELD

The invention relates to an active vibration noise control apparatus which reduces vibration noise by generating secondary vibration noise being a noise cancelation sound against vibration noise.

BACKGROUND ART

As an apparatus for reducing vibration noise by interference between vibration noise generated from a vibration noise source and secondary vibration noise, an active vibration noise control apparatus using an adaptive notch filter (or a single frequency adaptive notch) is known. In such an active vibration noise control apparatus, the amplitude and the phase of the secondary vibration noise can be adjusted by updating a filter coefficient of the adaptive notch filter. Although an update step size exists as a parameter for controlling an update amount of the filter coefficient, there is a case where a sudden change of the vibration noise source cannot be followed when the update step size is a constant value.

For addressing such a problem, for example, in Patent Document 1, a method is disclosed in which the update step size is changed depending on the rate of change in the frequency that vibration noise has. Further, in Patent Document 2, a method is disclosed in which the filter coefficient of the adaptive notch filter is changed based on an amplitude of the output from the adaptive notch filter just before an update.

PRIOR ART DOCUMENT

Patent Document

Patent Document 1: Japanese Unexamined Patent Publication No. H08-261277 (paragraph 0033)

Patent Document 2: Japanese Unexamined Patent Publication No. 2000-99037 (paragraph 0020)

SUMMARY OF THE INVENTION

Problems to be Solved by the Invention

However, in Patent Document 1 described above, since an effect of a transfer characteristic on a secondary path for the propagation of the secondary vibration noise is not taken into consideration, a problem arises in that an effect of stably reducing the vibration noise cannot be obtained. For example, in a case where the rate of change in the vibration noise frequency is small, but the gain in the transfer characteristic on the secondary path becomes large, an update amount of the filter coefficient becomes large, so that divergence might occur. Conversely, in a case where the rate of change in the vibration noise frequency is large, but the gain in the transfer characteristic on the secondary path is small, the update amount of the filter coefficient becomes excessively small, so that convergence could be slow.

In addition, also in Patent Document 2, an effect of the transfer characteristic on the secondary path is not taken into consideration, there exists a problem that an effect of stably reducing the vibration noise cannot be obtained. Furthermore, when a sudden frequency change of the vibration noise occurs, an adequate update step size for the transfer characteristic on the secondary path corresponding to the frequency after the change cannot be determined immediately, so that a delay in the convergence of the filter coefficient becomes a problem. In particular, in a case where the frequency of the vibration noise frequently changes, a certain level of delay always occurs, so that an effect of reducing the vibration noise cannot be obtained.

The present invention is accomplished to solve the above problems, and an object thereof is to provide an active vibration noise control apparatus which can stably reduce vibration noise.

An active vibration noise control apparatus according to the invention includes: a control signal filter which generates, from a signal having a frequency of vibration noise generated from a vibration noise source, a control signal to be converted to secondary vibration noise for reducing the vibration noise; an update step size calculation unit which calculates an update step size for determining an update amount of a filter coefficient of the control signal filter in accordance with a magnitude of a gain in a transfer characteristic corresponding to the frequency of the vibration noise, where the transfer characteristic is on a propagation path of the secondary vibration noise; and a filter coefficient update unit which updates the filter coefficient of the control signal filter based on the update step size calculated in the update step size calculation unit.

In addition, an active vibration noise control apparatus according to the invention includes: a control signal filter which generates a control signal from a signal having a frequency of vibration noise generated from a vibration noise source; a secondary vibration noise output unit which generates and outputs secondary vibration noise converted from the control signal, for reducing the vibration noise; an error detection unit which detects an error between the vibration noise and the secondary vibration noise, and outputs the detected error as an error signal; a reference signal filter which generates a reference signal from the signal having the frequency of the vibration noise based on the transfer characteristic on a path from the secondary vibration noise to the error detection unit; an update step size calculation unit which calculates an update step size for determining the update amount of the filter coefficient of the control signal filter in accordance with the magnitude of the gain in the transfer characteristic corresponding to the frequency of the vibration noise; and a filter coefficient update unit which updates the filter coefficient of the control signal filter based on the update step size, the reference signal, and the error signal.

Effect of the Invention

According to an active vibration noise control apparatus of the invention, the filter coefficient is updated based on the update step size calculated based on a magnitude of a gain in a transfer characteristic corresponding to the frequency of the vibration noise, where the transfer characteristic is on the propagation path of the secondary vibration noise. Thus, divergence of the filter coefficient or a delay in convergence, which are caused by an influence of the transfer characteristic on the secondary path, can be avoided, so that the vibration noise can be stably and effectively reduced.

EMBODIMENT FOR CARRYING OUT THE INVENTION

Embodiment 1

Figure 1:
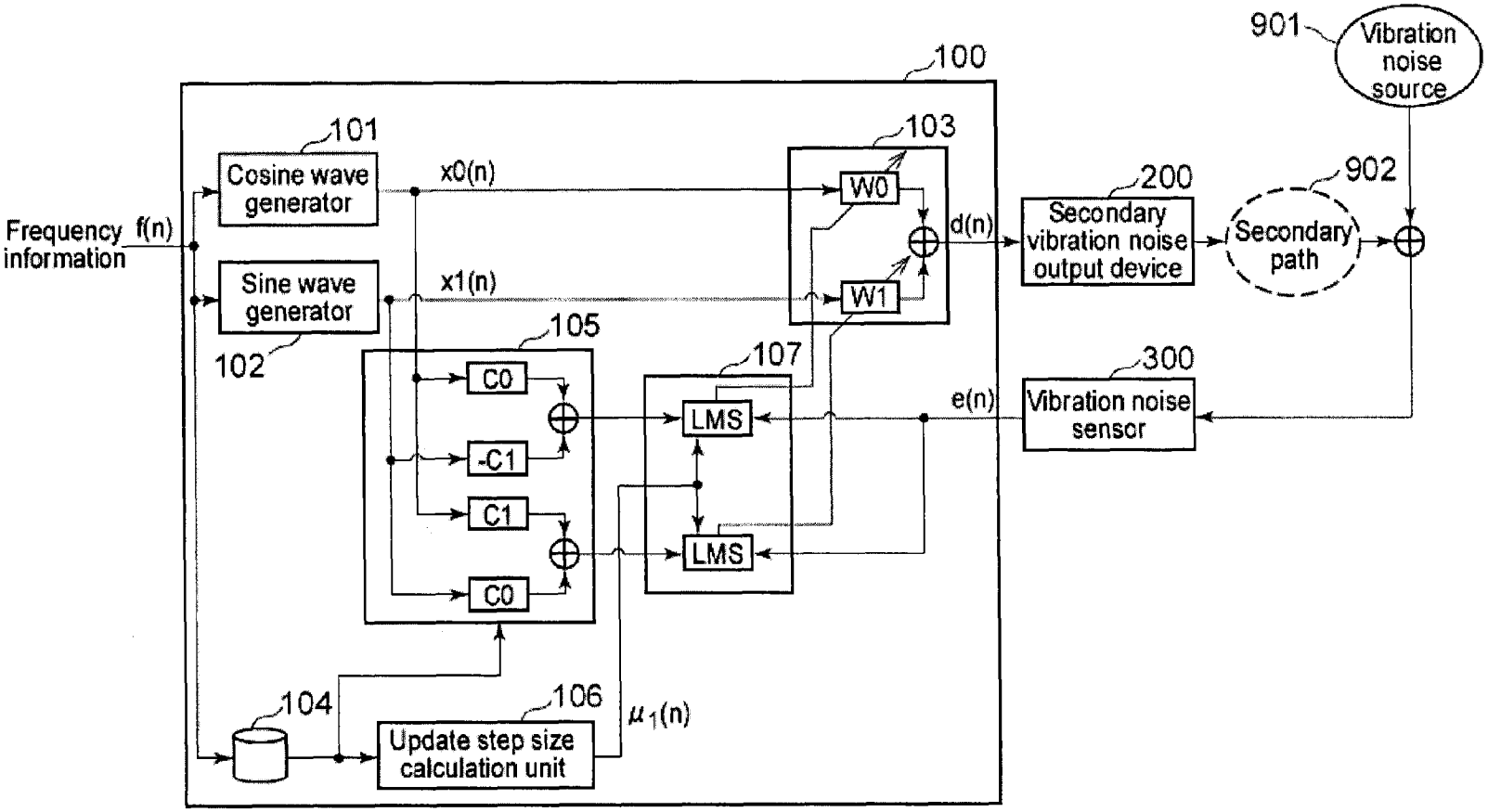
FIG. 1 is a block diagram of an active vibration noise control apparatus according to Embodiment 1.
Figure 2:
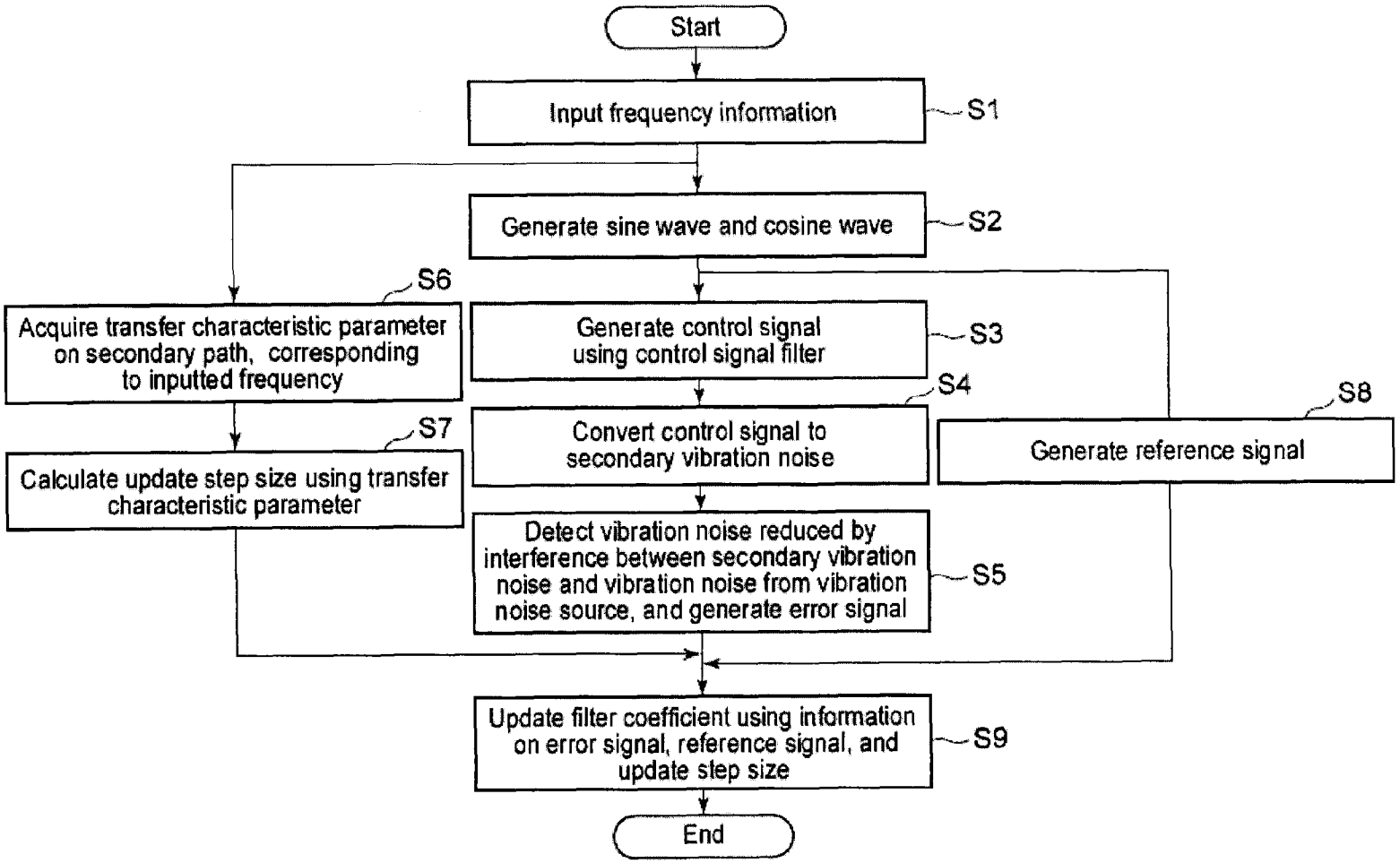
FIG. 2 is a flowchart showing an operation according to Embodiment 1.
Figure 3:
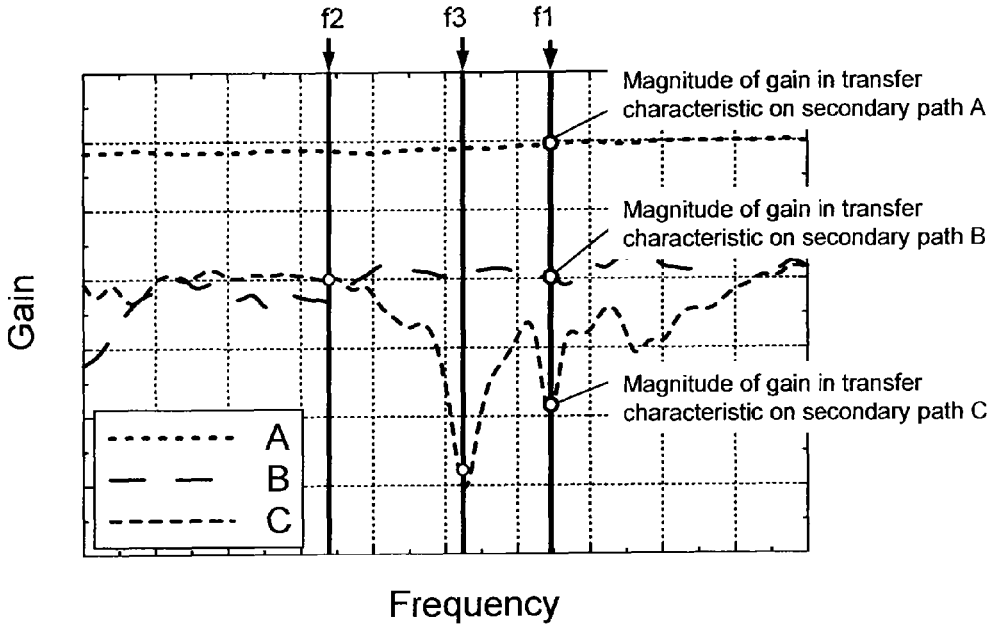
FIG. 3 illustrates an example of frequency vs. gain characteristic of secondary vibration noise according to Embodiment 1.
Figure 4:
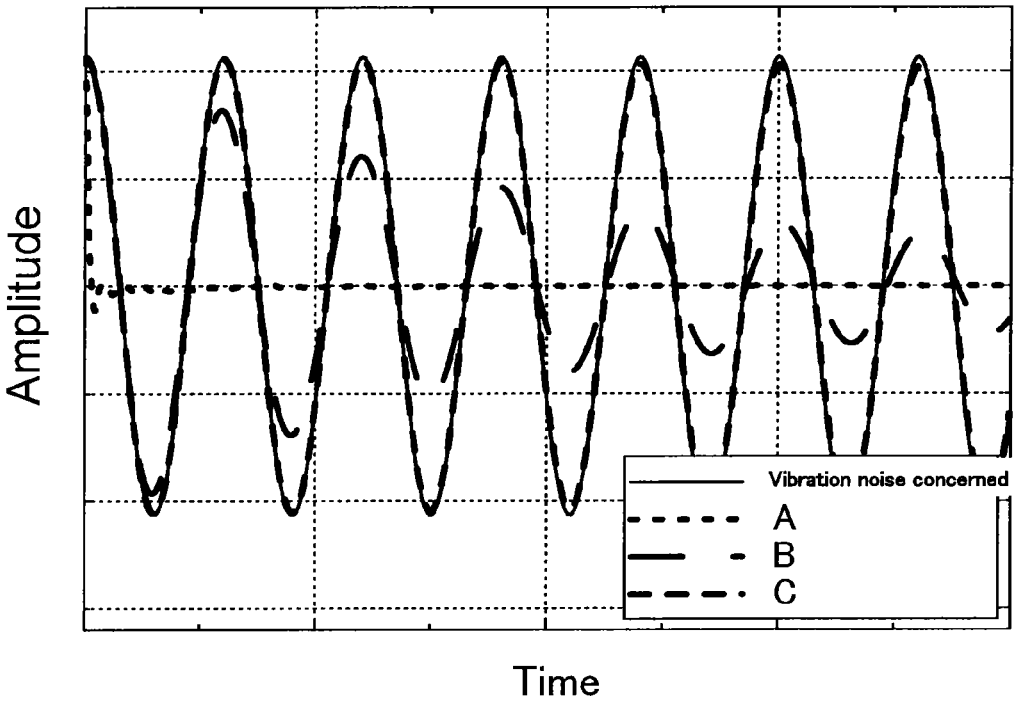
FIG. 4 illustrates an example showing an error convergence process according to Embodiment 1.
Figure 5:
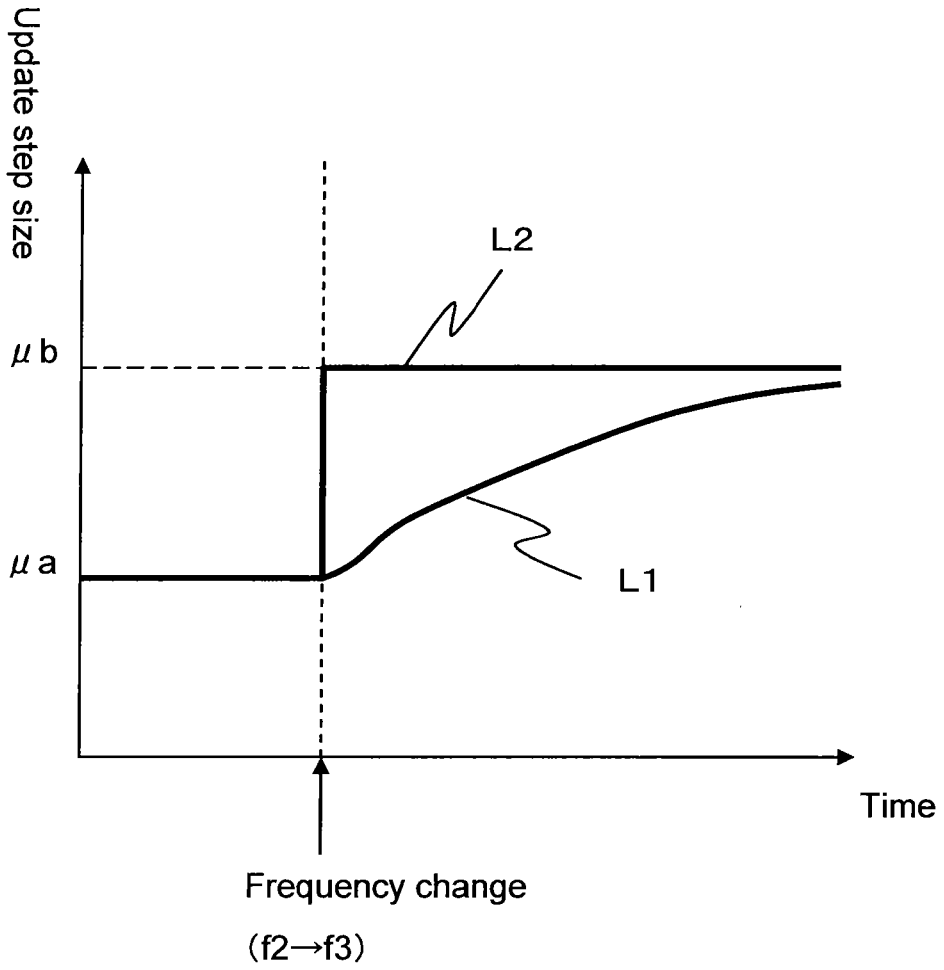
FIG. 5 is a diagram for explaining a method of determining an update step size in accordance with a frequency change according to Embodiment 1.

Hereinafter, Embodiment 1 of the invention will be described using figures. FIG. 1 is a block diagram of an active vibration noise control apparatus according to Embodiment 1. FIG. 2 is a flowchart showing an operation according to Embodiment 1. FIG. 3 illustrates an example of frequency vs. gain characteristic of secondary vibration noise, according to Embodiment 1. FIG. 4 illustrates an example showing an error convergence process, according to Embodiment 1. FIG. 5 is a diagram for explaining a method of determining an update step size in accordance with a frequency change, according to Embodiment 1.

As shown in FIG. 1, an active vibration noise control apparatus 100 according to Embodiment 1 of the invention is connected to a secondary vibration noise output device (secondary vibration noise output unit) 200 and a vibration noise sensor (error detection unit) 300 which are externally installed.

The active vibration noise control apparatus 100, to which frequency information on vibration noise from a vibration noise source 901 being a controlled object is inputted, outputs a control signal generated based on the inputted frequency information. The frequency information, for example, in the case where the vibration noise source is an automobile engine, can be obtained by such a method in which a rotational frequency of an engine is measured based on the period of ignition pulses, and then constant multiplication of the rotational frequency is performed in accordance with the rotational order of the engine generating vibration noise concerned. And, in the case of a fan driven by an electric motor, the frequency of a NZ-noise concerned can be obtained based on the number of the motor poles, the frequency of a power supply, and the number of fan blades, etc. For obtaining frequency information described above, a means suitable for vibration noise concerned may be adopted.

A secondary vibration noise output device 200 converts the control signal inputted from the active vibration noise control apparatus 100 to a secondary vibration noise for canceling the vibration noise generated by the vibration noise source 901, and outputs the secondary vibration noise. The device is realized with, for example, a speaker or an actuator, etc. The secondary vibration noise outputted from the secondary vibration noise output device 200 propagates through a secondary path 902, and interferes with the vibration noise generated from the vibration noise source, so that the vibration noise concerned is reduced. Here, the secondary path 902 is defined to be a path through which the second vibration noise outputted from the secondary vibration noise output device 200 propagates to the vibration noise sensor 300.

The vibration noise sensor 300 detects an error which is residual vibration noise generated by the interference between the secondary vibration noise and the vibration noise, outputs the detected error as an error signal e(n) to the active vibration noise control apparatus 100, and is realized using, for example, a mike, a vibration sensor, or an accelerometer, etc.

Next, a detailed configuration of the active vibration noise control apparatus 100 will be described. The active vibration noise control apparatus 100 includes a cosine wave generator 101, a sine wave generator 102, a control signal filter 103, a secondary path characteristic parameter storage 104, a reference signal filter 105, an update step size calculation unit 106, and a filter coefficient update unit 107.

The cosine wave generator 101 is a signal generator which generates a cosine wave signal corresponding to frequency information inputted from the outside. The cosine wave generator 101 outputs the generated cosine wave signal to the control signal filter 103.

The sine wave generator 102 is a signal generator which generates a sine wave signal corresponding to frequency information inputted from the outside. The sine wave generator 102 outputs the generated sine wave signal to the control signal filter 103. The sine wave signal and the cosine wave signal are the signals which have frequencies of the vibration noise.

The control signal filter 103 is a filter which synthesizes the control signal by filtering the cosine wave signal from the cosine wave signal generator 101 and the sin wave signal from the sine wave signal generator 102. The control signal, which will be described later in detail, is a signal to be converted into the secondary vibration noise for reducing the vibration noise.

The secondary path characteristic parameter storage (storage unit) 104 stores the magnitude of the gain in the transfer characteristic on the secondary path corresponding to the frequency of the vibration noise, as a secondary path characteristic parameter. The magnitude of the gain in the transfer characteristic corresponding to each frequency can be measured beforehand by carrying out an experiment, etc. The secondary path characteristic parameter storage 104 stores, for example, frequency information and secondary path characteristic parameters in a table format. When frequency information of the vibration noise is inputted, the secondary path characteristic parameter storage 104 outputs a secondary path characteristic parameter corresponding to an inputted frequency, to the reference signal filter 105 and the update step size calculation unit 106. Incidentally, a configuration may be possible in which the frequency information is inputted to the reference signal filter 105 and the update step size calculation unit 106. In this case, the reference signal filter 105 and the update step size calculation unit 106 to which the frequency information is inputted acquire the secondary path characteristic parameter corresponding to the inputted frequency information, from the secondary path characteristic parameter storage 104.

The reference signal filter 105 is a filter in which reference signals being signals relating to the vibration noise are synthesized based on a cosine wave signal from the cosine wave signal generator, a sine wave signal from the sine wave signal generator, and a transfer characteristic parameter from the secondary path characteristic parameter storage 104. The reference signal filter 105 outputs the synthesized reference signals to the filter coefficient update unit 107.

The update step size calculation unit 106 calculates an update step size being a parameter for controlling an update amount of filter coefficients of the control signal filter 103 based on a value of the secondary path characteristic parameter outputted from the secondary path characteristic parameter storage 104, and outputs the result to the coefficient update unit 107. That is, the update step size calculation unit 106 calculates the update step size in accordance with the magnitude of a gain in the transfer characteristic corresponding to the frequency of the vibration noise, where the transfer characteristic is on the secondary path through which the secondary vibration noise propagates. Incidentally, the update step size may be referred to as a step size parameter.

The filter coefficient update unit 107 updates the filter coefficients of the control signal filter 103 based on the updated step size calculated in the update step size calculation unit 106. More specifically, the filter coefficient update unit 107, using an adaptive algorithm such as the LMS (Least Mean Square) algorithm, updates the filter coefficients of the control signal filter 103 based on the error signal from the vibration sensor 300, the reference signals from the reference signal filter 105, and the update step size from the update step size calculation unit 106.

Next, an operation of Embodiment 1 of the invention will be described using FIG. 1 and FIG. 2.

First, information representing a frequency f(n) of the vibration noise is inputted to the cosine wave generator 101, the sine wave generator 102, and the secondary path characteristic parameter storage 104 which are provided in the active vibration noise control apparatus 100 (step S1). Then, the cosine wave generator 101 and the sine wave generator 102 output a cosine wave $x_0(n)$ of the frequency corresponding to the inputted frequency information and a sine wave $x_1(n)$ of the frequency corresponding to the inputted frequency information to the control signal filter 103 and the reference signal filter 105 (step S2). Here, n is a positive integer. It can be said that the cosine wave $x_0(n)$ and sine wave $x_1(n)$ are signals having frequencies of the vibration noise generated from the vibration noise source.

The control signal filter 103, when the cosine wave $x_0(n)$ and the sine wave $x_1(n)$ are inputted, carries out a process in which the cosine wave $x_0(n)$ and the sine wave $x_1(n)$ are multiplied by a control signal filter coefficient $w_0(n)$ and a control signal filter coefficient $w_1(n)$, respectively. Then, the control signal filter 103 carries out addition processing of the cosine wave $x_0(n)$ and the sine wave $x_1(n)$ after the multiplication for generating a control signal d(n), and outputs it to the secondary vibration noise output device 200 (step S3). The control signal d(n) is expressed in the following equation (1).

$$d(n)=w_0(n)x_0(n)+w_1(n)x_1(n) \tag{1}$$

The secondary vibration noise output device 200 converts the control signal d(n), which is outputted from the control signal filter 103, to the secondary vibration noise, and outputs it (step S4).

The secondary vibration noise outputted from the secondary vibration noise output device 200 propagates through the secondary path 902. The secondary vibration noise influenced by the transfer characteristic on the secondary path 902 interferes with the vibration noise generated from the vibration noise source 901, and then reduces the vibration noise. The vibration noise sensor 300 detects the reduced vibration noise, that is, the addition result of the secondary vibration noise and the vibration noise, which means an error being residual vibration noise, and generates an error signal e(n) representing the error (step S5). The vibration noise sensor 300 outputs the generated error signal e(n) to the filter coefficient update unit 107 in the active vibration noise control apparatus 100.

Meanwhile, the secondary path characteristic parameter storage unit 104, when information representing the frequency f(n) of the vibration noise is inputted, outputs the information on the transfer characteristic corresponding to the frequency f(n) as transfer characteristic parameters $C_0(f(n))$ and $C_0(f(n))$, to the reference signal filter 105 and the update step size calculation unit 106 (step S6), where the transfer characteristic is on the secondary path 902 through which the secondary vibration noise propagates. Here, the transfer characteristic parameters $C_0(f(n))$ and $C_0(f(n))$ are represented in the equation (2) below using an amplitude response A(f(n)) and a phase response θ(f(n)) for each frequency.

$$C_1(f(n))=A(f(n))\cos\theta(f(n))$$

$$C_1(f(n))=A(f(n))\sin\theta(f(n)) \tag{2}$$

The update step size calculation unit 106 calculates the update step size $\mu_1(n)$ based on the transfer characteristic parameters $C_0(f(n))$ and $C_1(f(n))$ outputted from the secondary path characteristic parameter storage unit 104, and the result is outputted to the filter coefficient update unit 107 (step S7). The update step size calculation unit 106, for example, as shown in the following equation (3), calculates the update step size $\mu_1(n)$ depending on the magnitudes of the transfer characteristic parameters $C_0(f(n))$ and $C_1(f(n))$. Here, μ(n) and a are constants which can be arbitrary defined in the ranges μ(n)>0 and a≥0.

$$\mu_1(n)=\frac{\mu(n)}{|C_0^2(f(n))+C_1^2(f(n))|^a} \tag{3}$$

The denominator of the right-hand side of the equation (3) represents the magnitude of the gain in the transfer characteristic on the secondary path 902 corresponding to the frequency f(n) of the vibration noise. That is, the update step size calculation unit 106 calculates an update step size $\mu_1$ which is inversely proportional to the magnitude of the gain in the transfer characteristic corresponding to the frequency f(n) of the vibration noise, wherein the transfer characteristic is on the secondary path 902 through which the secondary vibration noise propagates.

Here, when a=1, the denominator of the right-hand side of the equation (3) is to represent the gain in the transfer characteristic on the secondary path 902, and the update step size $\mu_1(n)$ is inversely proportional to the gain in the transfer characteristic on the secondary path 902. Therefore, when the gain in the transfer characteristic is large, the update step size $\mu_1$ will be reduced every time when the filter coefficients are updated, so that the filter coefficients are prevented from diverging, and when the gain in the transfer characteristic is small, the update step size $\mu_1$ will be increased every time when the filter coefficients are updated, so that the convergence is prevented from becoming slower. By calculating the update step size in such a way, the influence of the gain in the transfer characteristic on the secondary path 902 is eliminated, so that the vibration noise can be effectively reduced.

When receiving the cosine wave $x_0(n)$ inputted from the cosine wave generator 101 and the sine wave $x_1(n)$ inputted from the sine wave generator 102, and obtaining the transfer characteristic parameters $C_0(f(n))$ and $C_1(f(n))$ from the secondary path transfer characteristic parameter storage unit 104, the reference signal filter 105 generates reference signals $r_0(n)$ and $r_1(n)$ as shown in the equation (4) below, which relate to the vibration noise generated from the vibration noise source, and outputs them to the filter coefficient update unit 107 (step S8). That is, the reference signal filter 105 generates the reference signals $r_0(n)$ and $r_1(n)$ from the signals $x_0(n)$ and $x_1(n)$ having frequencies of the vibration noise, based on the transfer characteristic on the secondary path from the secondary vibration noise output device 200 to the vibration noise sensor 300.

$$r_0(n)=C_0(f(n))x_0(n)-C_1(f(n))x_1(n)$$

$$r_1(n)=C_1(f(n))x_0(n)-C_0(f(n))x_1(n) \quad (4)$$

The filter coefficient update unit 107 sequentially updates filter coefficients $w_0(n)$ and $w_1(n)$ of the control signal filter 103 as shown in the equation (5) below based on the error signal e(n) outputted from the vibration noise sensor 300, the update step size $\mu_1(n)$ outputted from the update step size calculation unit 106, and the reference signals $r_0(n)$ and $r_1(n)$ outputted from the reference signal filter 105 (step S9).

$$w_0(n+1)=w_0(n)+\mu_1(n)r_0(n)e(n)$$

$$w_1(n+1)=w_1(n)+\mu_1(n(r_1(n)e(n) \quad (5)$$

Here, using FIG. 3 and FIG. 4, the reason will be explained why the vibration noise can be stably and effectively reduced by updating the filter coefficients $w_0(n)$ and $w_1(n)$ of the control signal filter 103 using the update step size $\mu_1(n)$ in accordance with the gain in the transfer characteristic on the secondary path 902 corresponding to the frequency f(n) of the vibration noise.

FIG. 3 shows a graph of frequency vs. gain characteristic of secondary vibration noise, and the horizontal axis shows the frequency f(n), and the vertical axis shows the gain in the transfer characteristic on the secondary path. A, B, and C are the transfer characteristics on secondary paths which are different from each other, and the transfer characteristics each are different in gain depending on the frequency f(n). For example, in the case of frequency f1, the magnitude of the gain in the transfer characteristic is in descending order of the secondary paths A, B, and C. Further, FIG. 4 shows a graph regarding a convergence process of errors between the secondary vibration noise propagating in each secondary path A, B, and C shown in FIG. 3 and the vibration noise generated from the vibration noise source when a same update step size is used. And the horizontal axis shows the time, and the vertical axis shows the error amplitude. In the example of FIG. 4, the convergence speed is in descending order of the secondary paths A, B, and C, that is, in descending order of the magnitude of the gain in the transfer characteristic, and thus it can be seen that the magnitude of the gain in the transfer characteristic influences the convergence of the error.

Therefore, in order to make the convergence speed constant independently of the transfer characteristic on the secondary path, the filter coefficients should be updated using the update step size in accordance with the magnitude of the gain in the transfer characteristic on the secondary path. Namely, using the update step size in accordance with the magnitude of the gain in the transfer characteristic on each of the secondary paths A, B, and C, the convergence speed in any secondary path can be made comparable. In addition, as already described, since the magnitude of the gain in the transfer characteristic on the secondary path changes depending on the frequency, in order to stably and effectively reduce the vibration noise independently of the frequency, the update step size can be recalculated in accordance with the magnitude of the gain in the transfer characteristic corresponding to the frequency every time when it changes. The magnitude of the gain in the transfer characteristic corresponding to each frequency can be obtained in advance by an experiment, etc.

Furthermore, an operation will also be described in a case where the magnitude of the gain in the transfer characteristic suddenly changes due to a sudden change of the frequency. For example, in the case of the secondary path C shown in FIG. 3, it is assumed that the frequency of the vibration noise changes suddenly from f2 to f3. Here, it is assumed that an optimal update step size before the frequency change (frequency f2) is μa, and an optimal update step size after the frequency change (frequency f3) is μb. In the conventional method described before in which the update step size is determined by observing the amplitude of the output signal of the adaptive notch filter, the amplitude of the output signal gradually changes from the amplitude adjusted to the frequency f2 to the amplitude adjusted to the frequency f3, so that the update step size changes somewhat slowly from μa to μb as indicated by L1 in FIG. 5. Because of this, a delay will be generated to some extent until an optimal update step size is given in response to the change of the frequency.

In contrast, the update size calculation unit 106 according to the embodiment obtains the magnitude of the gain in the transfer characteristic corresponding to the frequency f3 after a change as transfer characteristic parameters $C_0$(f3) and $C_1$(f3) from the transfer characteristic parameter storage 104, uses the above equation (3), and immediately calculates the update step size μb as indicated by L2 in FIG. 5 right after the change of the frequency from f2 to f3, so that an optimal update step size can be used right after the change of the frequency.

Thus, in a case of the change in the frequency of the vibration noise, since the update step size calculation unit 106 can immediately calculate the update step size in accordance with the magnitude of the gain in the transfer characteristic corresponding to the frequency after a change, the vibration noise having the frequency after the change can be rapidly and stably reduced.

In addition, in the secondary path A shown in FIG. 3, in a case where the frequency of the vibration noise changes suddenly from f2 to f3, the magnitude of the gain in the transfer characteristic before and after the frequency change does not change much, so that the value of the update step size will not largely change. Thus the vibration noise can be stably reduced, and the divergence of the filter coefficients which will be caused by largely changing the update step size can be avoided.

As described above, according to Embodiment 1 of the invention, the filter coefficients of the control signal filter are updated based on the update step size determined in accordance with the change in the magnitude of the gain in the transfer characteristic corresponding to the frequency of the vibration noise, so that the divergence of the filter coefficients and the delay in the convergence caused depending on the transfer characteristic of the secondary path can be avoided, and the vibration noise can be stably and effectively reduced.

Furthermore, even in a case where the frequency of the vibration noise suddenly changes, the update step size in accordance with the magnitude of the gain in the transfer characteristic corresponding to the frequency after the change is immediately calculated, so that the vibration noise having the frequency after the change can be rapidly and stably reduced.

Incidentally, the explanation has been made heretofore assuming the secondary vibration noise output device 200 and the vibration noise sensor 300 are connected outside of the active vibration noise control apparatus 100. However, a configuration in which they are provided inside the active vibration noise control apparatus 100 may be possible.

Embodiment 2

Figure 6:
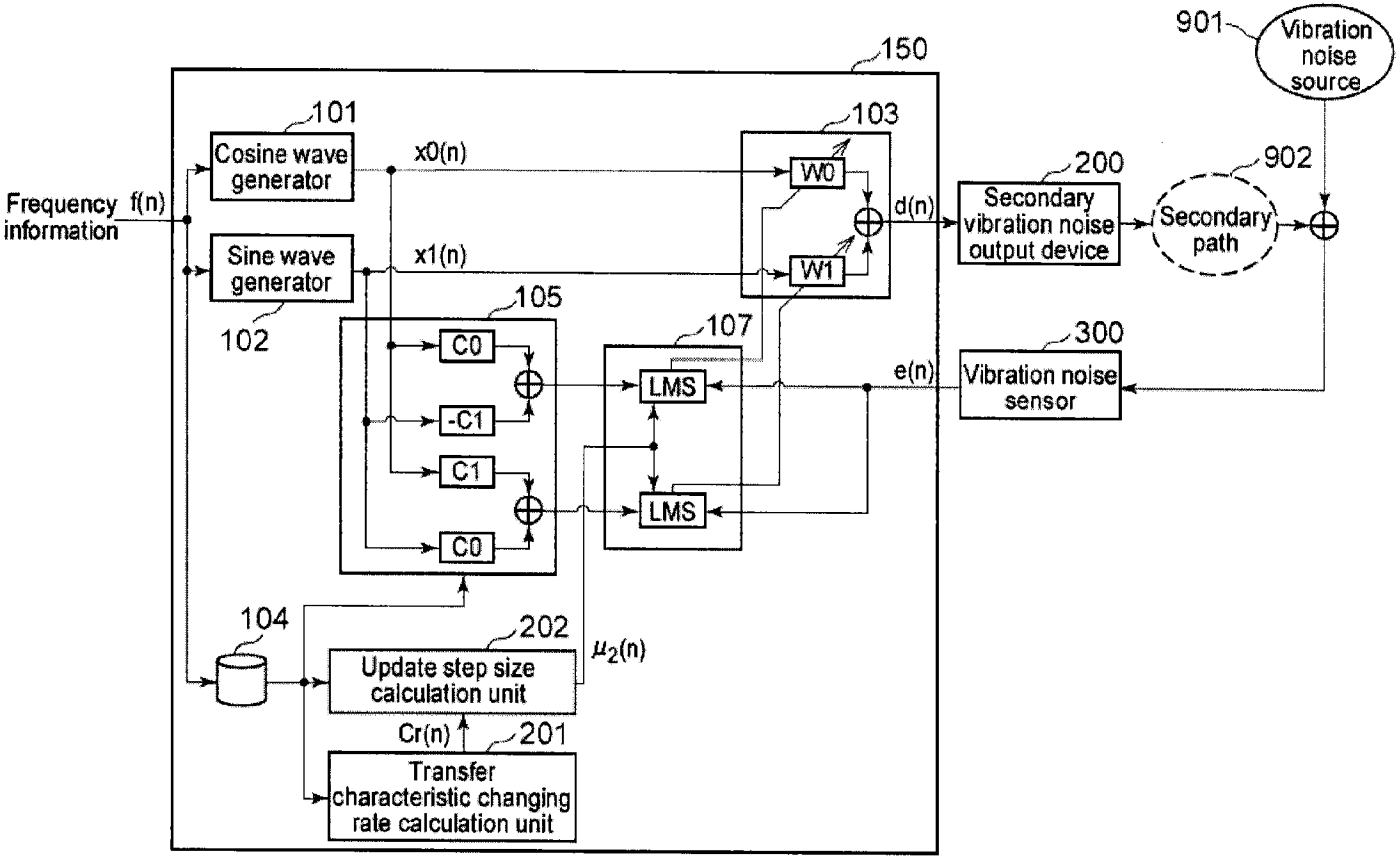
FIG. 6 is a block diagram of an active vibration noise control apparatus according to Embodiment 2.
Figure 7:
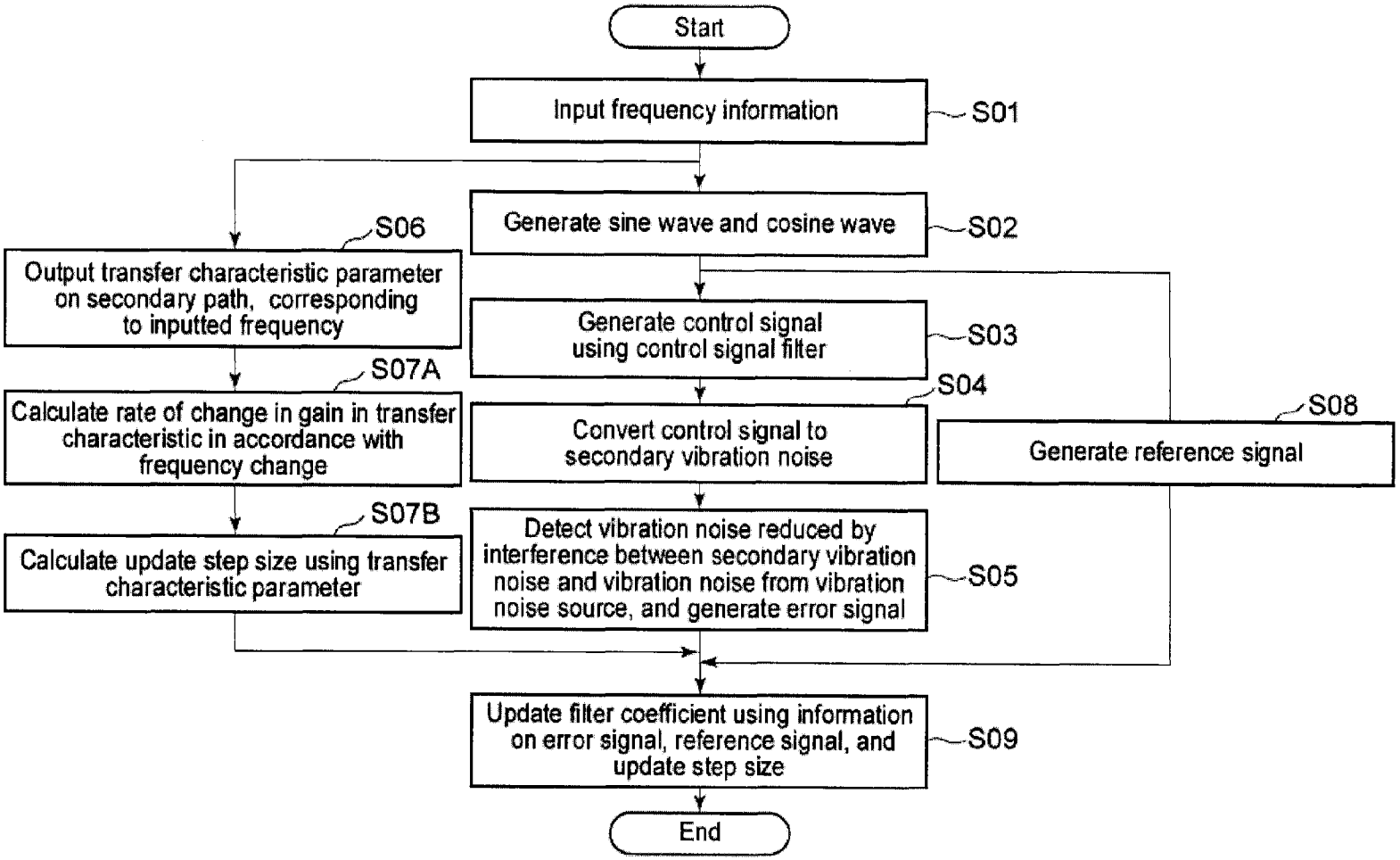
FIG. 7 is a flowchart showing an operation according to Embodiment 2.
Figure 8:
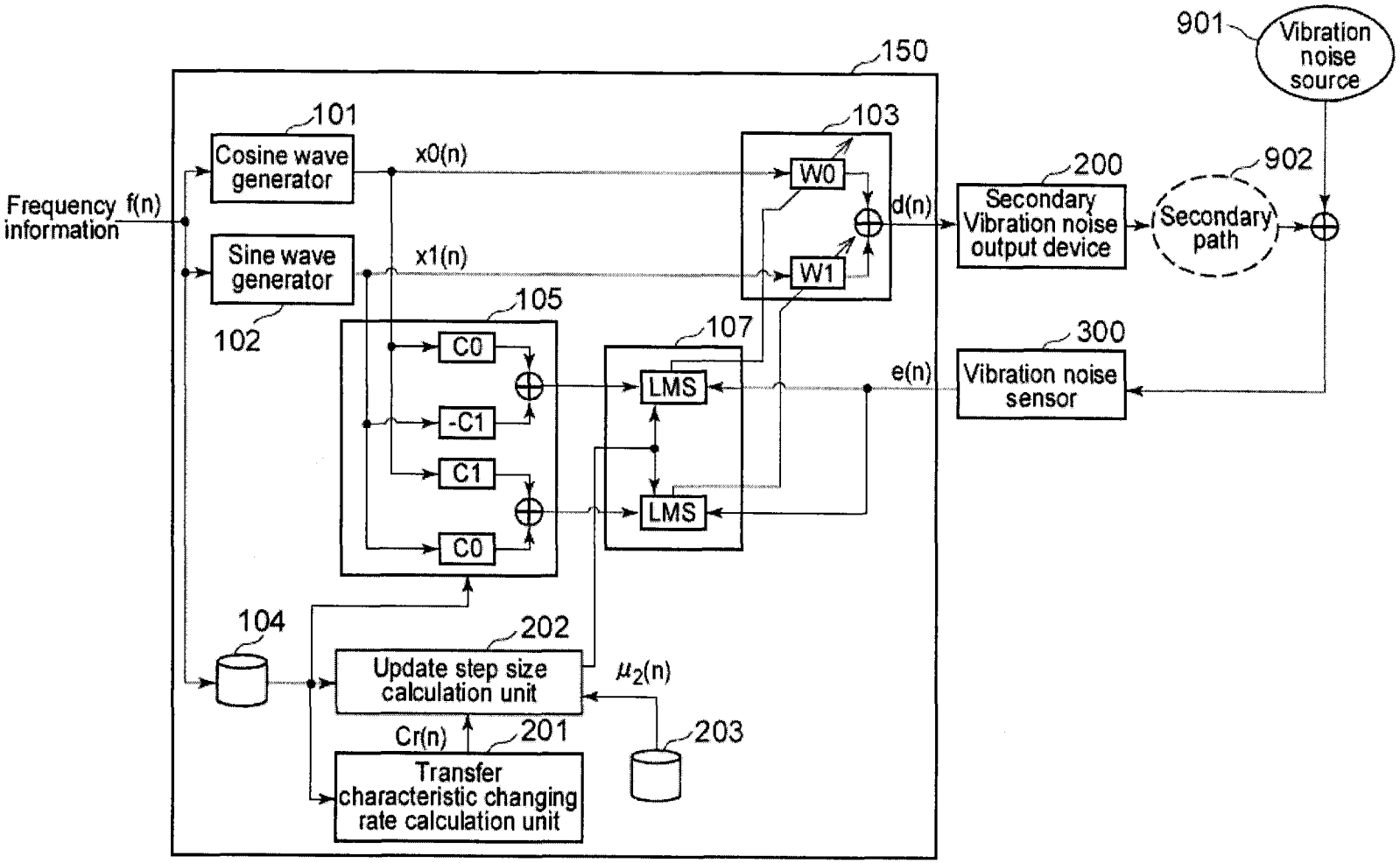
FIG. 8 is a block diagram of another example of an active vibration noise control apparatus according to Embodiment 2.

Hereinafter, Embodiment 2 of the invention will be explained using figures. FIG. 6 is a block diagram of an active vibration noise control apparatus according to Embodiment 2. FIG. 7 is a flowchart showing an operation according to Embodiment 2. FIG. 8 is a block diagram of another example of an active vibration noise control apparatus according to Embodiment 2.

As shown in FIG. 6, an active vibration noise control apparatus 150 according to Embodiment 2 includes a cosine wave generator 101, a sine wave generator 102, a control signal filter 103, a secondary path characteristic parameter storage 104, a reference signal filter 105, a filter coefficient update unit 107, a transfer characteristic changing rate calculation unit 201, and an update step size calculation unit 202. It is noted that parts corresponding to the components of the active vibration noise control apparatus in Embodiment 1 are denoted by the same reference signs as those used in FIG. 1, and descriptions thereof will be omitted.

The transfer characteristic changing rate calculation unit 201 calculates the rate of change in the magnitude of the gain in the transfer characteristic in accordance with the frequency change of the vibration noise (hereinafter, simply referred to as transfer characteristic changing rate) based on the transfer characteristic parameter obtained from the secondary path characteristic parameter storage 104, and outputs the rate to the update step size calculation unit 202.

The update step size calculation unit 202 calculates an update step size based on a value of a secondary path transfer characteristic parameter outputted from the secondary path transfer parameter storage 104 and a transfer characteristic changing rate outputted from the transfer characteristic changing rate calculation unit 201, and outputs the update step size to the filter coefficient update unit 107.

Next, an operation of Embodiment 2 of the invention will be explained using FIG. 6 and FIG. 7. Since the steps S01-S05, S08, and S09 in FIG. 7 respectively correspond to the steps S1-S5, S8, and S9 in FIG. 2 explained in Embodiment 1, the explanation is omitted.

The secondary path transfer parameter storage 104, when information representing the frequency f(n) of the vibration noise is inputted, outputs transfer characteristic parameters $C_0(f(n))$ and $C_1(f(n))$ to the reference signal filter 105, the update step size calculation unit 202, and the transfer characteristic changing rate calculation unit 201 (step S6).

The transfer characteristic changing rate calculation unit 201 calculates a transfer characteristic changing rate Cr(n) based on the transfer characteristic parameters $C_0(f(n))$ and $C_1(f(n))$ outputted from the secondary path transfer parameter storage 104, and outputs it to the update step size calculation unit 202 (step S07A).

When the frequency of the vibration noise changes from f(n-T) to f(n), the transfer characteristic changing rate Cr(n) is expressed in the equation (6) below. Here, b and T are predetermined constants which satisfy b≥0 and T>0, respectively.

$$Cr(n)=|C_0(f(n))-C_0(f(n-T))|^b+|C_1(f(n))-C_1(f(n-T))|^b \tag{6}$$

The update step size calculation unit 202 calculates an update step size $\mu_2(n)$ being a parameter for controlling an update amount of the filter coefficients of the control signal filter 103 based on the secondary path transfer characteristic parameters $C_0(f(n))$ and $C_1(f(n))$ outputted from the secondary path transfer parameter storage 104, and the transfer characteristic changing rate Cr(n) calculated in the transfer characteristic changing rate calculation unit 201, and outputs the update step size $\mu_2(n)$ to the filter coefficient update unit 107 (step S07B). More specifically, the update step size calculation unit 202 calculates $\mu_1(n)$ from the above equation (3) using the secondary path transfer characteristic parameters $C_0(f(n))$ and $C_1(f(n))$, and calculates the update step size $\mu_2(n)$, for example, from the equation (7) below. Here, g(n) is a correction value determined based on the transfer characteristic changing rate Cr(n), and q is a predetermined constant which satisfies q≥0. That is, the update step size calculation unit 202 calculates the update step size $\mu_2(n)$ based on the magnitude of the gain in the transfer characteristic on the secondary path and the rate of change in the magnitude of the gain in the transfer characteristic.

$$\mu_2(n)=\mu_1(n)\{g(n)+q\} \tag{7}$$

In other words, the update step size calculation unit 202 calculates a corrected update step size $\mu_2(n)$ by correcting the update step size $\mu_1(n)$ calculated based on the transfer characteristic parameters $C_0(f(n))$ and $C_1(f(n))$ using a correction value g(n) calculated based on the transfer characteristic changing rate Cr(n). Here, the correction value g(n) may be a linear function of the transfer characteristic changing rate Cr(n) shown in the equation (8) below, for example, and h is a predetermined constant which satisfies h>0.

$$g(n)=h\cdot Cr(n) \tag{8}$$

Further, the correction value g(n) may be a step function, for example, expressed in the equation (9) below, and m and the threshold TH are predetermined constants which satisfy m>0 and TH>0, respectively. In this case, the update step size calculation unit 202 assigns m to the correction value g(n) in the case when the transfer characteristic gain changing rate Cr(n) becomes equal to or larger than the threshold TH shown in the equation (9), and calculates the update step size $\mu_2(n)$ from the equation (7). That is, in the case when the transfer characteristic changing rate Cr(n) becomes equal to or larger than the threshold TH, the update step size calculation unit 202 calculates the update step size $\mu_2(n)$ based on the magnitude of the gain in the transfer characteristic and the rate of change in the magnitude of the gain in the transfer characteristic.

Thus, as can be seen from the equations (7) through (9), the update step size calculation unit 202 increases the update step size $\mu_2(n)$ when the transfer characteristic changing rate Cr(n) increases, and decreases the update step size $\mu_2(n)$ when the transfer characteristic changing rate Cr(n) decreases.

$$g(n)=\begin{cases}0 & Cr(n)<TH\\ m & Cr(n)\geq TH\end{cases} \tag{9}$$

As described above, according to Embodiment 2 of the invention, the update step size, which is calculated in accordance with the magnitude of the gain in the transfer characteristic on the secondary path corresponding to the frequency of the vibration noise, is adjusted by the correction value calculated based on the rate of change in the magnitude of the gain in the transfer characteristic in accordance with the frequency change of the vibration noise, so that the convergence speed of the filter coefficients can be more accelerated than that in the case of Embodiment 1.

Furthermore, right after the frequency change of the vibration noise is settled, for example, in the case where the transfer characteristic changing rate changes from Cr(n)≥TH to Cr(n)<TH in the above equation (9), the update step size calculation unit 202 does not decrease the update step size $\mu_2$ immediately, but may decrease it gradually. For example, with a modification on the correction value as shown in the following equation (10), the update step size $\mu_2(n)$ can be gradually decreased. Here, g'(n) is a modified correction value, and $\alpha$ is a predetermined constant which satisfies $0<\alpha<1$.

$$g'(n)=g'(n-1)*\alpha+g(n) \quad (10)$$

Namely, when the changing rate Cr(n) becomes smaller than the predetermined threshold, the update step size calculation unit 202 determines that it is a moment right after the frequency change is settled, and calculates a correction value from the above equation (10), and then, calculates the update step size $\mu_2(n)$ from the above equation (7) using the calculated correction value g'(n). This allows the update step size $\mu_2(n)$ to decrease gradually, so that the filter coefficients converge rapidly, and an effect of reducing the vibration noise can be enhanced even in the case where the filter coefficients have not converged sufficiently right after the frequency change is settled.

Incidentally, the active vibration noise control apparatus 150 according to Embodiment 2 of the invention may be configured to include a correction value storage 203 in which the transfer characteristic changing rates Cr(n) are stored in association with the correction values. In such a configuration, the update step size calculation unit 202, when the transfer characteristic changing rate Cr(n) is outputted from the transfer characteristic changing rate calculation unit 201, obtains a correction value corresponding to the outputted transfer characteristic changing rate Cr(n) from the correction value storage 203. And then the update step size calculation unit 201 calculates the update step size from the above equation (7) using the correction value obtained from the correction value storage 203, and outputs it to the filter coefficient update unit 107.

Thus, the correction value storage 203 stores predetermined correction values, so that a process for calculating the correction value in the update step size calculation unit 202 is not needed, and the update step size can be calculated with less amount of computation.

EXPLANATION OF REFERENCE NUMERALS

100, 150 Active vibration noise control apparatus
101 Cosine wave generator
102 Sine wave generator
103 Control signal filter
104 Secondary path transfer characteristic parameter storage
105 Reference signal filter
106, 202 Update step size calculation unit
107 Filter coefficient update unit
200 Secondary vibration noise output device
201 Transfer characteristic changing rate calculation unit
203 Correction value storage
300 Vibration noise sensor
901 Vibration noise source
902 Secondary path

The invention claimed is:

1. An active vibration noise control apparatus comprising:
a control signal filter which generates, from a signal having a frequency of vibration noise generated from a vibration noise source, a control signal to be converted to secondary vibration noise for reducing the vibration noise;
an update step size calculation unit which calculates an update step size for determining an update amount of a filter coefficient of the control signal filter in inverse proportion to a magnitude of a gain in a transfer characteristic corresponding to the frequency of the vibration noise, the transfer characteristic being on a propagation path of the secondary vibration noise; and
a filter coefficient update unit which updates the filter coefficient of the control signal filter based on the update step size calculated in the update step size calculation unit.

2. The active vibration noise control apparatus according to claim 1, wherein, if the frequency of the vibration noise changes, the update step size calculation unit calculates the update step size in inverse proportion to the magnitude of the gain in the transfer characteristic corresponding to the frequency after the change.

3. The active vibration noise control apparatus according to claim 1, further comprising a storage in which the frequency of the vibration noise and the magnitude of the gain in the transfer characteristic corresponding to the frequency of the vibration noise are stored in association with each other,
wherein the update step size calculation unit calculates the update step size using the magnitude of the gain in the transfer characteristic corresponding to the frequency of the vibration noise obtained from the storage.

4. The active vibration noise control apparatus according to claim 1, further comprising a transfer characteristic changing rate calculation unit which calculates the rate of change in the magnitude of the gain in the transfer characteristic in accordance with a frequency change of the vibration noise,
wherein the update step size calculation unit calculates the update step size based on the magnitude of the gain in the transfer characteristic and the rate of change in the magnitude of the gain in the transfer characteristic calculated in the transfer characteristic changing rate calculation unit.

5. The active vibration noise control apparatus according to claim 4, wherein the update step size calculation unit calculates, if the rate of change in the magnitude of the gain in the transfer characteristic becomes larger than a predetermined threshold, the update step size based on the magnitude of the gain in the transfer characteristic and the rate of change in the magnitude of the gain in the transfer characteristic.

6. The active vibration noise control apparatus according to claim 5, wherein the update step size calculation unit gradually decreases the update step size if the rate of change in the magnitude of the gain in the transfer characteristic becomes smaller than the predetermined threshold.

7. The active vibration noise control apparatus according to claim 1, further comprising a reference signal filter which generates a reference signal from a signal having the frequency of the vibration noise based on the transfer characteristic on a propagation path of the secondary vibration noise,
wherein the filter coefficient update unit updates the filter coefficient of the control signal filter based on the reference signal, the update step size, and an error signal representing an error between the secondary vibration noise and the vibration noise.

8. An active vibration noise control apparatus comprising:
a control signal filter which generates a control signal from a signal having a frequency of vibration noise generated from a vibration noise source;

a secondary vibration noise output unit which generates and outputs secondary vibration noise converted from the control signal, for reducing the vibration noise;

an error detection unit which detects an error between the vibration noise and the secondary vibration noise, and outputs the detected error as an error signal;

a reference signal filter which generates a reference signal from the signal having the frequency of the vibration noise based on a transfer characteristic on a path from the secondary vibration noise to the error detection unit;

an update step size calculation unit which calculates an update step size for determining an update amount of a filter coefficient of the control signal filter in inverse proportion to a magnitude of a gain in the transfer characteristic corresponding to the frequency of the vibration noise; and a filter coefficient update unit which updates the filter coefficient of the control signal filter based on the update step size, the reference signal, and the error signal.

* * * * *